US006928934B2

(12) United States Patent
Zheng

(10) Patent No.: US 6,928,934 B2
(45) Date of Patent: Aug. 16, 2005

(54) FOLDABLE TABLE WITH FOUR BAR LINK

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 76 days.

(21) Appl. No.: 10/434,698

(22) Filed: May 8, 2003

(65) Prior Publication Data

US 2004/0221773 A1 Nov. 11, 2004

(51) Int. Cl.[7] ..... A47B 3/00

(52) U.S. Cl. ..... 108/127; 108/129; 248/439; 248/188.6

(58) Field of Search ..... 108/124, 150, 108/127–129, 169, 174; 248/188.1, 188.6, 439

(56) References Cited

U.S. PATENT DOCUMENTS 441,569 A * 11/1890 Ladd ..... 108/132
2,318,945 A * 5/1943 Johannsen ..... 108/133
2,666,683 A * 1/1954 Pucci ..... 108/131
4,838,180 A * 6/1989 Gutgsell ..... 248/188.6
5,390,610 A * 2/1995 Gutgsell ..... 248/188.6
5,562,051 A * 10/1996 Rizzi ..... 248/439
5,606,922 A * 3/1997 Adams et al. ..... 108/129
5,636,578 A * 6/1997 Rizzi ..... 108/129
6,032,585 A * 3/2000 Pinch ..... 108/129
6,530,331 B2 * 3/2003 Stanford ..... 108/129

FOREIGN PATENT DOCUMENTS

DE 4000321 * 9/1990 ..... 248/188.1

* cited by examiner

*Primary Examiner*—Lanna Mai
*Assistant Examiner*—Hanh Tran
(74) *Attorney, Agent, or Firm*—Rutan & Tucker, LLP

(57) ABSTRACT

A foldable table includes a table top coupled to a frame, and a pedestal that is coupled to the side rails and end rails of the frame via a four bar link.

13 Claims, 2 Drawing Sheets

FOLDABLE TABLE WITH FOUR BAR LINK

FIELD OF THE INVENTION

The field of the invention is foldable furniture.

BACKGROUND OF THE INVENTION

Foldable furniture, and especially foldable tables are relatively popular and numerous manners of making tables foldable are known in the art. For example, many foldable tables include legs that are directly attached to the table at one end of the leg via a pivot, while other tables include legs that are removably attached to the table via a pivot. Direct attachment via a pivot is typically relatively simple, however, often requires considerable space for folding the legs and may pose risk of unintended collapse of the table when the table is being pushed in one or another direction. Removable legs significantly improve stability, however, folding tables with removable legs is often cumbersome.

Still other tables include legs in which one or two legs are attached to the table via a four bar link, wherein the bars of the four bar link are either attached on the sides of the table. For example, Ladd describes in U.S. Pat. No. 441,569 a foldable bed in which a four bar link is coupled to the side rails of the bed and assists folding of the front and rear legs. Similarly, as shown in U.S. Pat. Nos. 2,057,778 and 2,318,945, a four bar link mechanism in a foldable table is attached to side rails of the table. While such configurations may add at least some stability and ease of folding, various disadvantages still remain. Among other things, where the four bar link is attached to the sides or side rails, stacking of such tables id often problematic as the legs protrude from the underside of the table.

To circumvent at least some of the problems associated with stacking, Pucci describes in U.S. Pat. No. 2,666,683 a foldable table in which the four bar link is attached to the inside surface of the table circumference, thus allowing stacking/folding of the table when the legs are folded underneath the table. However, in such configurations, the stability is greatly dependent on the table circumference. Still further, Puccis's configurations without a specific locking mechanism are more likely to collapse when the table is being pushed in one or another direction.

Alternatively, as described in U.S. Pat. Nos. 4,838,180 5,636,578, the four bars of the four bar link may be attached to a mounting platform, which is in turn attached to the table top. Such configurations advantageously allow positioning of the leg or legs in a more central position (i.e., between the sides of the table, and/or between the ends of the table). However, to provide at least some stability to the table, the mounting platform typically requires solid attachment to the underside of the table top, and further requires that the table top is of sufficient rigidity to accommodate front-to-back and/or side-to-side forces impinging on the table. Therefore, mounting platforms are generally not useful in conjunction with a table top made from light-weight material (e.g., blow molded plastic).

Thus, while numerous configurations for folding tables are known in the art, all or almost all of them suffer from one or more disadvantages. Therefore, there is still a need to provide improved apparatus and methods for foldable tables, and especially foldable tables with a four bar link.

SUMMARY OF THE INVENTION

The present invention is directed to configurations and methods for a foldable table having a frame coupled to a table top, and in which the pedestals are coupled to the frame via a four bar link, wherein two of the four bars in the four bar link are pivotably coupled to the side rails of the frame and wherein another two bars of the four bar link are pivotably coupled to the end rails of the frame.

In one aspect of the inventive subject matter, a table includes a table top coupled to a frame that includes a first and a second side rail and a first and a second end rail. A pedestal is disposed between the first and second side rails and coupled to the frame via a four bar link, wherein the four bar link includes a first and second swivel bar and a first and second pivot bar, wherein the first and second swivel bars are pivotably coupled to the pedestal and pivotably coupled to the end rail, wherein the first and second pivot bars are pivotably coupled to the pedestal and pivotably coupled to the side rail, and wherein the pedestal moves from an open configuration to a closed configuration in a single movement.

It is further generally preferred that contemplated tables comprise a blow mold table top having an upper circumferential edge and a lower circumferential edge, wherein the pedestal is between the upper and lower circumferential edge when the pedestal is in the closed configuration. Moreover, the width of the pedestals is preferably less than the width of the table top, and the pedestal preferably two load-bearing columns that are coupled to each other. In yet further preferred aspects, the table top has a length LT, the frame has a length LF, the first swivel bar has a length LS, and wherein LT is greater or equal than LF+LS.

Additionally, or optionally, it is contemplated that table top comprises an element that releasably engages with at least one of the pedestal and the first swivel bar when the pedestal is in the open and/or closed configuration to provide further stability to the table. Still further contemplated aspects include tables in which the pedestal and the table top form an angle of less than 85 degree when the pedestal in an open configuration.

Thus, particularly preferred tables will include a table top fabricated from blow molded plastic, the table top having an upper surface, and a recessed lower surface. A frame is coupled to the lower surface, wherein the frame comprises a first side rail substantially parallel to a second side rail, and wherein respective ends of the first and second side rails are coupled to each other via a first end rail and a second end rail. Furthermore, such tables will include a pedestal comprising two load-bearing columns that are coupled to each other, wherein the pedestal is pivotably coupled to the frame via a four bar link, wherein the four bar link includes a first and second swivel bar and a first and second pivot bar, wherein the first swivel bar is pivotably coupled to one end of one of the load-bearing columns of the pedestal and pivotably coupled to the end rail, and wherein the second swivel bar is pivotably coupled to one end of another of the load-bearing columns of the pedestal and pivotably coupled to the end rail, wherein the first pivot bar is pivotably coupled to the one of the load-bearing columns of the pedestal and pivotably coupled to the first side rail, and wherein the second pivot bar is pivotably coupled to the another of the load-bearing columns of the pedestal and pivotably coupled to the second side rail, and wherein the pedestal moves from an open configuration to a closed configuration in a single movement.

Various objects, features, aspects and advantages of the present invention will become more apparent from the following detailed description of preferred embodiments of the invention, along with the accompanying drawings in which like numerals represent like components.

DETAILED DESCRIPTION

The inventor surprisingly discovered that foldable tables with superior stability and light weight may be manufactured in which the pedestals are coupled to a frame via a four bar link.

As used herein, the term "disposed between the first and second side rails" refers to a position that is located in a space that is delimited by the innermost portions of the side rails and that expressly excludes the side rails. Therefore, a pedestal that directly or via a pivot contacts a portion of the side rail is not considered between the first and second side rails. In contrast, pedestals of tables contemplated herein are typically at least 1 cm, and more typically at least 10 cm apart from the innermost portion of a side rail.

As also used herein, the term "swivel bar" refers to an element that pivotably couples the pedestal to an end rail, wherein the swivel bar is pivotably coupled to both the end rail and the pedestal. Most preferably, the pivotable coupling of the swivel bar to the pedestal and the end rail is in a position at, or proximal (i.e., within less than 25% of the total length of the swivel bar) to the ends of the swivel bar. Similarly, the term "pivot bar" as used herein refers to an element that pivotably couples the pedestal to a side rail, wherein the pivot bar is pivotably coupled to both the side rail and the pedestal. Most preferably, the pivotable coupling of the pivot bar to the pedestal and the side rail is in a position distal (i.e., within at least 10% of the total length of the swivel bar) to the end of the side bar and distal to the upper end (when the table is in the open configuration) of the pedestal As further used herein, the term "open configuration" refers to a configuration of the table in which the pedestal or pedestals are folded away from the table top such that the pedestals will support the table top off the ground. Therefore, the term "open configuration" is particularly used when the table is in operation, i.e., both pedestals are folded away from the table top and support the table off the ground. Similarly, the term "closed configuration" refers to a configuration of the table in which the pedestal or pedestals are folded towards the table top. Therefore, the term "closed configuration" is particularly used when the table is snot in operation and stored away, i.e., both pedestals are folded towards the table top.

As still further used herein, the term "in a single movement" refers to a movement in which the table is converted from the closed configuration to the open configuration (or vice versa) without at least momentarily interrupting the movement to unlock a locking mechanism (e.g., slide ring, lever, bolt, etc.) that would otherwise prevent the pedestal from one configuration into another configuration.

Figure 1:
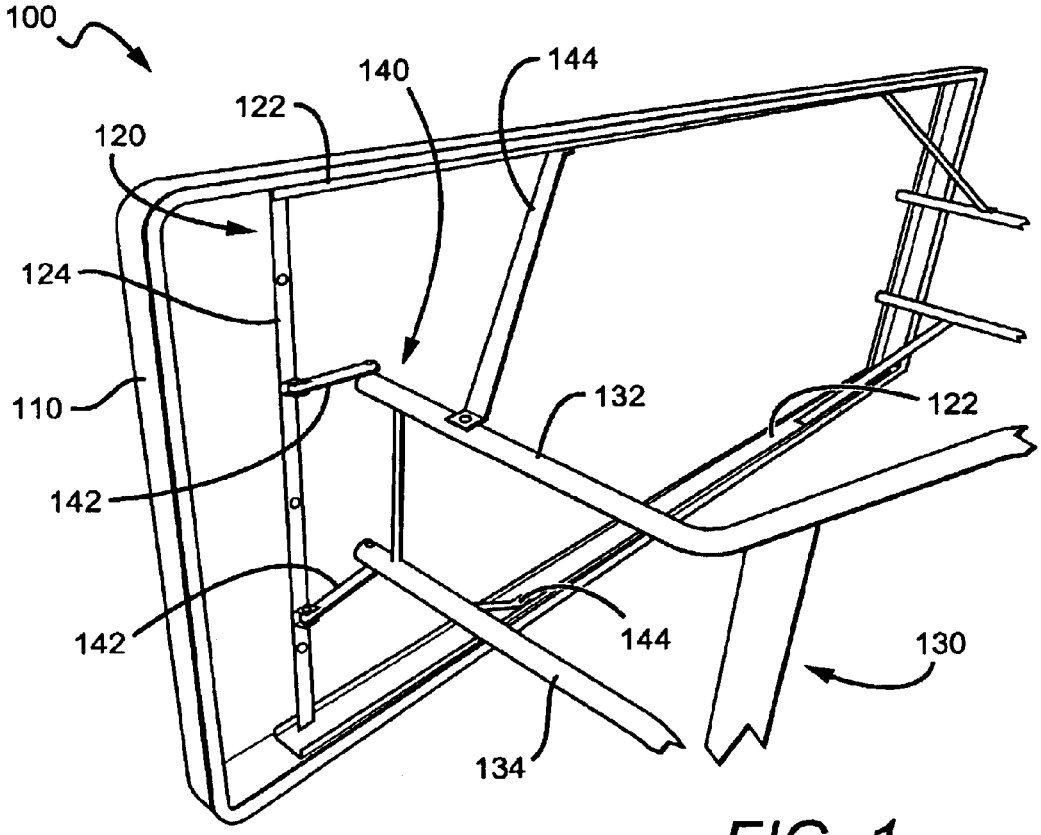
FIG. 1 is a photograph of an exemplary table in open configuration.

In an especially preferred aspect of the inventive subject matter as shown in FIG. 1, a table 100 has a table top 110 and a frame 120 having a pair of side rails 122 and a pair of end rails 124. Pedestals 130 having load-bearing columns 132 and 134 are coupled to the frame via four bar link 140. Four bar link 140 has a pair of swivel bars 142 which are on one end pivotably coupled to the end rail 124, and which are on the other end pivotably coupled to the upper end of the load-bearing columns 132 and 134. Four bar link 140 further has a pair of pivot bars 144 which are on one end pivotably coupled to the side rails 122, and which are on the other end pivotably coupled to the load-bearing columns 132 and 134 at a position below the coupling with the swivel bar (when the table is in the open configuration). The frame 120 is coupled to the table top 110 via screws that connect the end rails with the underside of the table top and screws that connect the ends of the side rails with the inner circumferential portion of the table top.

Figure 2:
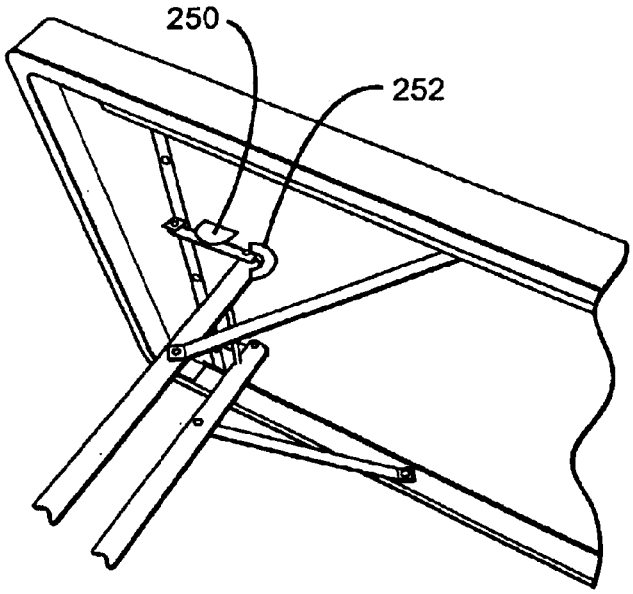
FIG. 2 is a detail view of the photograph of FIG. 1.
Figure 3:
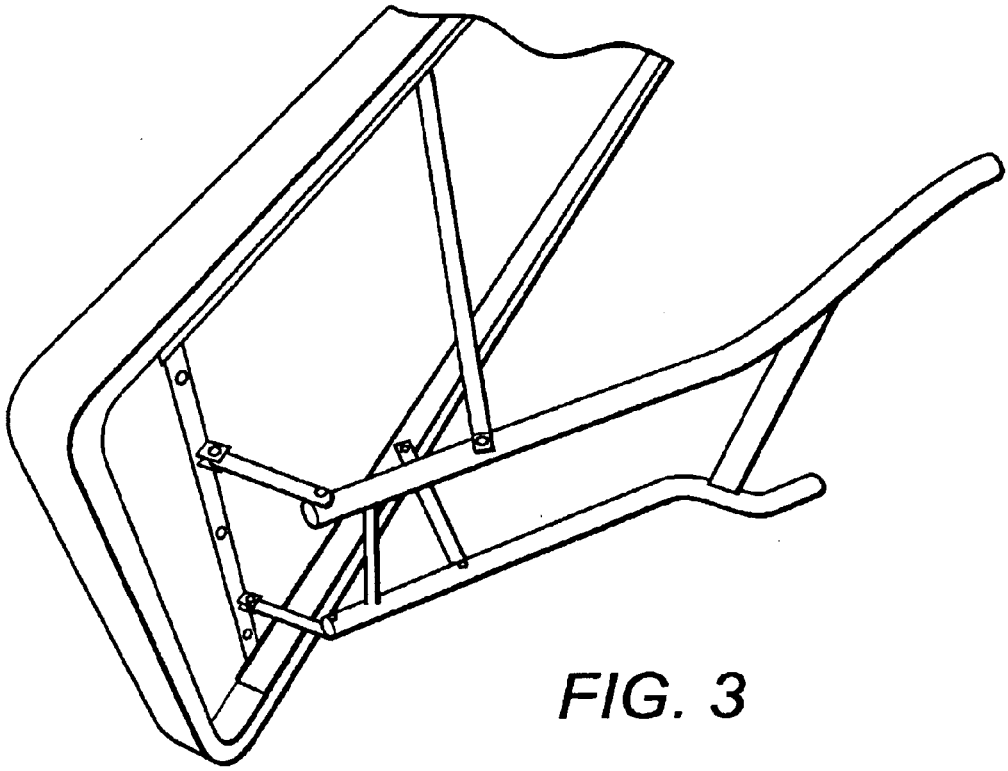
FIG. 3 is a photograph of the table of FIG. 1 in partially folded configuration.
Figure 4:
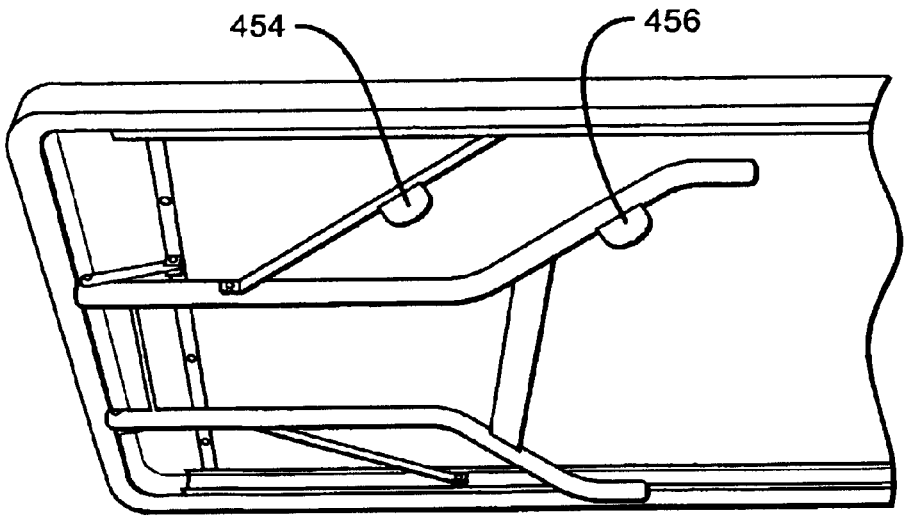
FIG. 4 is a photograph of the table of FIG. 1 in folded configuration.

FIG. 2 depicts a detail view of the pivotable couplings in the four bar link and further schematically illustrates releasable coupling elements 250 and 252 that engage with the swivel bar and/or the pedestal, respectively, when the table is in an open configuration. FIG. 3 depicts the table of FIG. 1 in a partially folded configuration, and FIG. 4 shows the table of FIG. 1 in a closed configuration with releasable coupling elements 454 and 456 that engage with the pivot bar and/or the pedestal, respectively, when the table is in a closed configuration.

Thus, in a particularly preferred aspect of the inventive subject matter, contemplated tables will include a table top that is coupled to a frame, wherein the frame includes a first and a second side rail, each of which are coupled to a first and a second end rail, respectively. Contemplated tables will further comprise a pedestal that is disposed between the first and second side rails, and that is coupled to the frame via a four bar link, wherein the four bar link includes a first and second swivel bar and a first and second pivot bar, wherein the first and second swivel bars are pivotably coupled to the pedestal and pivotably coupled to the end rail, wherein the first and second pivot bars are pivotably coupled to the pedestal and pivotably coupled to the side rail, and wherein the pedestal moves from an open configuration to a closed configuration in a single movement.

With respect to the table top, it is generally preferred that the table top is fabricated from a light-weight material and especially preferred materials include blow molded plastic. However, it should be recognized that numerous alternative table tops may also be employed in conjunction with the teachings presented herein, and suitable table tops include those fabricated from plastic (e.g., polyethylene, polystyrene, polycarbonate, polyamide), metal (e.g., aluminum, titanium), wood, fiberglass, textile materials, and all reasonable combinations thereof.

Furthermore, it should be recognized that the dimensions of the table top may vary considerably, and that a particular dimension will generally (and at least in part) depend on the particular purpose for the table. For example, where a table is used as a platform for display of light-weight material (e.g., papers, brochures, etc.) in a trade show, suitable table dimensions may be between 5–8 feet in length and 3–4 feet in width. On the other hand, where contemplated tables are to support relatively heavy loads in a chemically aggressive environment (scientific instruments in a laboratory), suitable table dimensions may be between 3–5 feet in length and 2–4 feet in width.

It is still further especially preferred (but not necessary) that contemplated tables will include an upper circumferential edge (coplanar with the table top upper surface) and a lower circumferential edge (extending below the lower surface of the table top and thus forming a rim). In tables using such table tops, it is desirable that the pedestal in the closed configuration will be disposed between the upper and lower circumferential edge to facilitate stacking of the tables in closed configuration (e.g., the lower circumferential edge of one table will contact the upper circumferential edge of the next table in a stack of tables)

Additionally, or alternatively, contemplated table tops may further comprise an element that releasably engages with at least one of the pedestal and the first swivel bar when the pedestal is in the open configuration, and/or an element that releasably engages with at least one of the pedestal and the first pivot bar when the pedestal is in the closed configuration. Suitable elements are preferably elastic protrusions and/or indentations from the underside of the table top that receive the respective element of the four bar link or pedestal to retain the respective element of the four bar link or pedestal.

With respect to the pedestal, it is generally contemplated that the configuration may vary considerably, and all known pedestals for tables are considered suitable for use herein. For example, especially preferred pedestals will include two load-bearing columns that may be straight or curved, and that are preferably coupled to each other for improved stability and coordination of movement from the open to the closed configuration. Alternatively, single-post pedestals with two or more attached feet may be coupled to the frame.

Therefore, contemplated tables will include those in which the pedestal has a width that is substantially less that the side-to-side width of the table top. For example, suitable pedestals may have a width WP at the pivotal coupling of the pedestal to the end rail, while the table top has a side-to-side width WT, wherein WP is no greater than 0.8, and more typically no greater than 0.6 times WT. Consequently, it should be especially recognized that the pedestal in contemplated tables will have support in all three dimensions: Front-to-back support via the swivel bar, side-to-side support via the pivot bar, and top-to-bottom support by the pedestal structure itself. While not wishing to be bound by any theory or hypothesis, the inventor contemplates that the exceptional stability of contemplated tables may be at least in part attributable to the three-dimensional support.

Furthermore, it should be appreciated that suitable pedestals are pivotably coupled to both, the swivel bar(s) and the pivot bar(s). Depending on the particular location of the coupling, it should be recognized that the pedestal will be in a rectangular position (relative to the table top) when the table is in an open configuration, or form an angle with the table top, preferably of less than 85 degree, when the pedestal in an open configuration. Thus, it should be recognized that the location of coupling of the swivel bar and/or the pivot bar to the pedestal may vary substantially. Moreover, where even higher stability and protection against inadvertent collapse is desired, the swivel bar may be coupled to the end rail and/or pedestal such that the swivel bar forms an angle (pivot point with pedestal closer to the table top than the pivot point with the end rail) with the table top when the table is in the open configuration.

With respect to the frame, it is generally contemplated that the frame may be fabricated from a variety of materials, and it should be appreciated that all known materials for table frames are considered suitable for use in conjunction with the teachings presented herein. However, particularly preferred materials include metals, alloys, fiberglass, polymeric materials, and all reasonable combinations thereof. End rails and side rails may be coupled to each other in various manners, and it should be recognized the particular manner of coupling is not critical to the inventive subject matter. For example, the frame may be permanently assembled (e.g., welded, bolted, unitary construction) or non-permanently (e.g., screwed) assembled. Similarly, the shape of suitable side and end rails may vary considerably. However, it is generally preferred that the side and end rails may have a Z-profile, or may be tubular structures (round or rectangular). Furthermore, additional side rails and/or end rails may be included into the frame to provide various functions.

Suitable frames may further have any size relative to the table top, so long as the frame at least partially supports the table top. However, in especially preferred aspects of the inventive subject matter, the frame has a length and width that is less than the length and width of the table top. Furthermore, in especially preferred aspects of the inventive subject matter, the table top has a length LT, the frame has a length LF, the first swivel bar has a length LS, wherein LT is greater or equal than LF+LS. Still further, it should be recognized that the frame may be configured such that the frame can be folded into a more compact size. For example, the frame may include a joint in the side rails that allows further folding of the table (provided that the table top is foldable as well or comprises two separate elements).

Consequently, a particularly preferred table will include a table top fabricated from blow molded plastic, the table top having an upper surface, and a recessed lower surface. In such tables, a frame is coupled to the lower surface, wherein the frame comprises a first side rail substantially parallel (i.e., forming an angle no more than +/−10 degrees relatively to each other) to a second side rail, wherein the respective ends of the first and second side rails are coupled to each other via a first end rail and a second end rail. A pedestal comprising two load-bearing columns (preferably coupled to each other) is pivotably coupled to the frame via a four bar link, wherein the four bar link includes a first and second swivel bar and a first and second pivot bar. The first swivel bar is pivotably coupled to one end of one of the load-bearing columns of the pedestal and pivotably coupled to the end rail, and the second swivel bar is pivotably coupled to one end of another of the load-bearing columns of the pedestal and pivotably coupled to the end rail. Furthermore, the first pivot bar is pivotably coupled to the one of the load-bearing columns of the pedestal and pivotably coupled to the first side rail, and the second pivot bar is pivotably coupled to the another of the load-bearing columns of the pedestal and pivotably coupled to the second side rail, wherein the pedestal moves from an open configuration to a closed configuration in a single movement.

Thus, specific embodiments and applications of foldable tables with four bar link have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A foldable table comprising:

a table top coupled to a frame that includes a first and a second side rail and a first and a second end rail;

a pedestal disposed between the first and second side rails and coupled to the frame via a four bar link, wherein the four bar link includes a first and second swivel bar and a first and second pivot bar;

wherein the first and second swivel bars are pivotably coupled to the pedestal and pivotably coupled to one of the end rails;

wherein the first and second pivot bars are pivotably coupled to the pedestal and pivotably coupled to the side rails;

wherein the pedestal moves from an open configuration to a closed configuration in a single movement; and wherein the pedestal has a width (WP) at the pivotal coupling of the pedestal to the end rail, and the table ton has a side-to-side width (WT) and wherein the pedestal width (WP) is no greater than 0.8 times the table top side-to-side width (WT).

2. The table of claim 1 wherein the table top comprises a blow mold table top having an upper circumferential edge and a lower circumferential edge, and wherein the pedestal is between the upper and lower circumferential edge when the pedestal is in the closed configuration.

3. The table of claim 1 pedestal width (WP) is not greater than 0.6 the table top side-to-side width (WT).

4. The table of claim 1 wherein the pedestal comprises two load-bearing columns that are coupled to each other.

5. The table of claim 1 wherein the table top has length (LT), the frame has a length (LF), the first swivel bar has a length (LS) and wherein (LT) is greater or equal than the frame length (LF) plus the first swivel bar length (LS).

6. The table of claim 1 wherein the table top comprises an element that releasably engages with at least one of the pedestal and the first swivel bar when the pedestal is in the open configuration.

7. The table of claim 1 wherein the table top comprises an element that releasably engages with at least one of the pedestal and the first swivel bar when the pedestal is in the closed configuration.

8. The table of claim 1 wherein the pedestal and the table top form an angle of less than 85 degrees when the pedestals in an open configuration.

9. A foldable table comprising:

a table top fabricated from blow molded plastic, the table top having an upper surface, and a recessed lower surface;

a frame coupled to the lower surface, wherein the frame comprises a first side rail substantially parallel to a second side rail, wherein respective ends of the first and second side rails are coupled to each other via a first end rail and a second end rail;

a pedestal comprising two load-bearing columns that are coupled to each other, and wherein the pedestal is pivotably coupled to the frame via a four bar link, and wherein the four bar link includes a first and second swivel bar and a first and second pivot bar;

wherein the first swivel bar is pivotably coupled to one end of one of the load-bearing columns of the pedestal and pivotably coupled to one of the first and second end rails and wherein the second swivel bar is pivotably coupled to one end of other of the load-bearing columns of the pedestal and pivotably coupled to one of the first and second end rails;

wherein the first pivot bar is pivotably coupled to the one of the load-bearing columns of the pedestal and pivotably coupled to the first side rail, and wherein the second pivot bar is pivotably coupled to the other of the load-bearing columns of the pedestal and pivotably coupled to the second side rail;

wherein the pedestal has a width (WP) at the pivotal coupling of the load-bearing columns to the end rail, and the table top has a side-to-side width (WT), and wherein the pedestal width (WP) is no greater than 0.8 times the table top side-to-side with (WT); and wherein the pedestal moves from an open configuration to a closed configuration in a single movement.

10. The table of claim 9 wherein the recessed lower surface further comprises an element that releasably engages with at least one of the load-bearing columns of the pedestal and the first swivel bar when the pedestal is in the open configuration.

11. The table of claim 9 wherein the recessed lower surface further comprises an element that releasably engages with at least one of the load-bearing columns of the pedestal and the first swivel bar when the pedestal is in the closed configuration.

12. The table of claim 9, pedestal width (WP) is not greater than 0.6 the table top, and wherein side-to-side width (WT).

13. The table of claim 9 wherein the pedestal and the table top form an angle of less than 85 degrees when the pedestal is in an open configuration.

* * * * *